US005803268A

United States Patent [19]

Levy et al.

[11] Patent Number: 5,803,268

[45] Date of Patent: Sep. 8, 1998

[54] DOUBLE-ENDED PERFUME BOTTLE

[75] Inventors: Brad Levy; Judy Levy, both of Youngstown, Ohio; Robert DuGrenier, New York, N.Y.

[73] Assignee: Fragrance International, Inc., Youngstown, Ohio

[21] Appl. No.: 610,154

[22] Filed: Feb. 29, 1996

[51] Int. Cl.[6] ..... A45D 34/00; B65D 1/04; B65D 1/06

[52] U.S. Cl. ..... 206/581; 206/235; 206/823; 215/6; 215/10; 220/23.83; 132/315

[58] Field of Search ..... 215/6, 10, DIG. 8, 215/12.1, 378; 206/235, 581, 823; 220/23.83; 132/314

[56] References Cited

U.S. PATENT DOCUMENTS

| | | | |
|---|---|---|---|
| 178,818 | 6/1876 | Warner | 215/6 X |
| 582,380 | 5/1897 | Tebbutt . | |
| 1,598,085 | 8/1926 | Kirschmann | 215/6 |
| 1,728,883 | 9/1929 | Simon | 215/6 |
| 2,178,997 | 11/1939 | Mitchell | 132/314 |
| 2,458,063 | 1/1949 | Dulberg | 132/314 |
| 2,669,017 | 2/1954 | Seko | 206/581 X |
| 2,889,065 | 6/1959 | Lawlor | 215/12.1 |
| 3,102,650 | 9/1963 | Seaver | 215/12.1 |
| 3,470,929 | 10/1969 | Thornton . | |
| 3,744,622 | 7/1973 | Weaver | 215/12.1 X |
| 3,856,138 | 12/1974 | Maekawa et al. | 215/DIG. 8 X |
| 4,651,899 | 3/1987 | Pauls et al. | 215/DIG. 8 X |

FOREIGN PATENT DOCUMENTS

| | | | |
|---|---|---|---|
| 2373248 | 7/1978 | France | 132/314 |
| 366032 | 12/1938 | Italy | 215/6 |
| 884140 | 12/1961 | United Kingdom | 220/23.83 |

OTHER PUBLICATIONS

"Oil & Vinegar Cruet" from The Paragon Spring–Summer 1996 catalog 89 Tom Harvey Rd, Westerly, RI 02891.

*Primary Examiner*—Sue A. Weaver
*Attorney, Agent, or Firm*—Browdy and Neimark

[57] ABSTRACT

A bottle for perfume and the like has two separate compartments. Each of two interior spaces has its own closure/dispenser (eg. spray fitting or pump), one at each end, so that two different liquids can be contained and dispensed separately in different ways. An outer container space is defined between an outer wall and an inner wall; the inner containing space is inside the inner wall. The inner and outer walls are joined where the neck of the inner-wall container meets the bottom of the outer-wall container. The bottle may include end caps which cover the two closures/dispensers at either end, for a symmetrical, elongated shape somewhat like a cigar. The ends caps may also double as closures.

9 Claims, 2 Drawing Sheets

DOUBLE-ENDED PERFUME BOTTLE

FIELD OF THE INVENTION

The present invention relates to containers, especially for perfume and other fragrance containing toiletry liquids such as cologne, after-shave, hand lotion, and the like.

DESCRIPTION OF KNOWN RELATED ART

In the prior art, bottles and other liquid containers are known which include a capped opening on an upper end and an auxiliary opening or openings, such as an air vent, in the bottom or a side of the bottle. Also known are rigid containers with two inner compartments separated by a flaccid or resilient membrane, and also liquid-holding containers having plural side-by-side compartments.

Ordinary vacuum bottles (Dewar flasks, e.g. "THERMOS" bottles) typically include a rigid outer container and a rigid (e.g. glass or stainless steel) inner bottle joined by its neck to the outer container. That is, the outer container has an upper opening to which is fastened the neck of the inner bottle. The space between the inner bottle and the outer container is evacuated, for thermal insulation of the bottle contents. This space is un-usable for holding any liquid or gas, because such use would destroy the thermal insulating properties which are the reason for the double-walled construction.

There is no known bottle which includes inner and outer container walls defining an inner chamber and an annular surrounding chamber, where the chambers can hold two separated liquids and each liquid is separately accessible.

SUMMARY OF THE INVENTION

Accordingly, the present invention has an object, among others, to overcome deficiencies in the prior art such as noted above.

Another object of the present invention is to provide a bottle with two spaces that can hold two separate liquids and in which each liquid is separately dispensable.

A further object is to allow two liquids to be dispensed from one bottle through two closures of different types; for example, one liquid dispensed by a spray fitting and another by removing a screw-on cap.

Yet another object is to provide a bottle that is of novel, intriguing and attractive construction.

The present invention relates generally to a bottle that includes two separated spaces for holding two different liquids. Each space has its own distinct closure. The first and second closures allow the two different liquids, each held in a respective one of the two spaces, to be dispensed independently and also by different means. For example, one liquid may be dispensed through a spray fitting and the other through a pump fitting.

The bottle includes an inner wall and an outer wall. An inner space, closed by the first closure, is surrounded by the inner wall. The outer wall surrounds the inner wall, and the annular space between the inner and the outer walls is the outer space, which holds the second liquid for dispensing through the second closure. The inner compartment or space is thus protected not only by its own wall, but also by the liquid in the outer annular space and the outer wall.

A first liquid, held in the first space between the inner and outer container walls, is dispensed through a first opening through the outer wall, to which is fitted a first closure. Where the neck of the inner-wall container meets the bottom of the outer-wall container, the two walls are joined so that the second liquid in the inner enclosed by the inner wall is dispensed through a second opening fitted with a second closure.

Preferably, the bottle includes end caps which cover the two closures at either end, and when the caps are placed on the ends of the bottle the entire bottle has a symmetrical, elongated shape somewhat like a cigar or torpedo.

BRIEF DESCRIPTION OF THE DRAWING

The above and other objects and the nature and advantages of the present invention will become more apparent from the following detailed description of an embodiments taken in conjunction with drawings, wherein.

DETAILED DESCRIPTION OF THE PREFERRED EMBODIMENT

Figure 1:
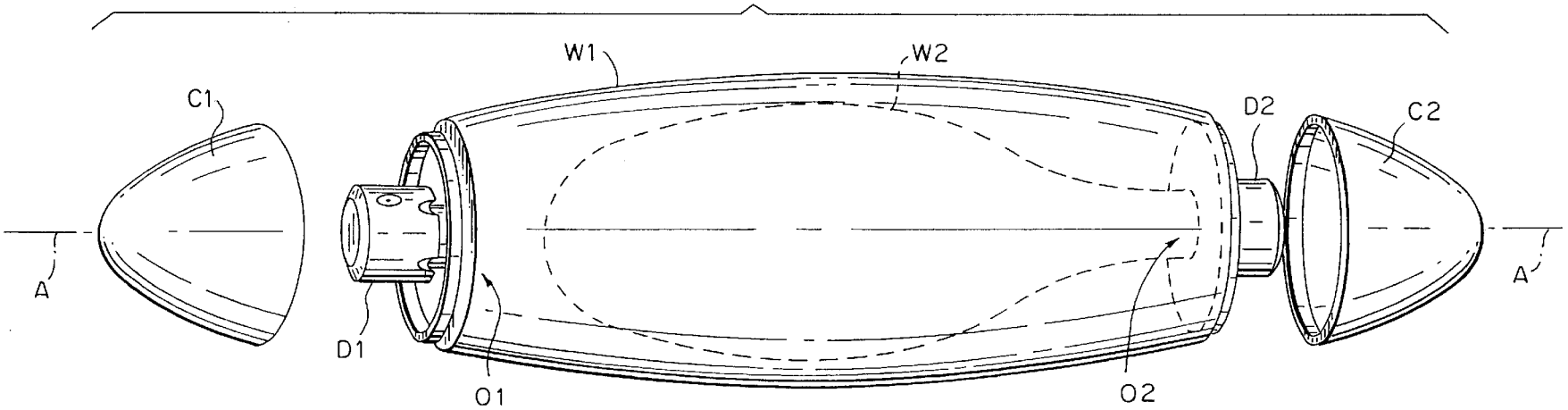
FIG. 1 is a perspective view of the invention showing the caps exploded away from the container portion of the bottle.
Figure 2:
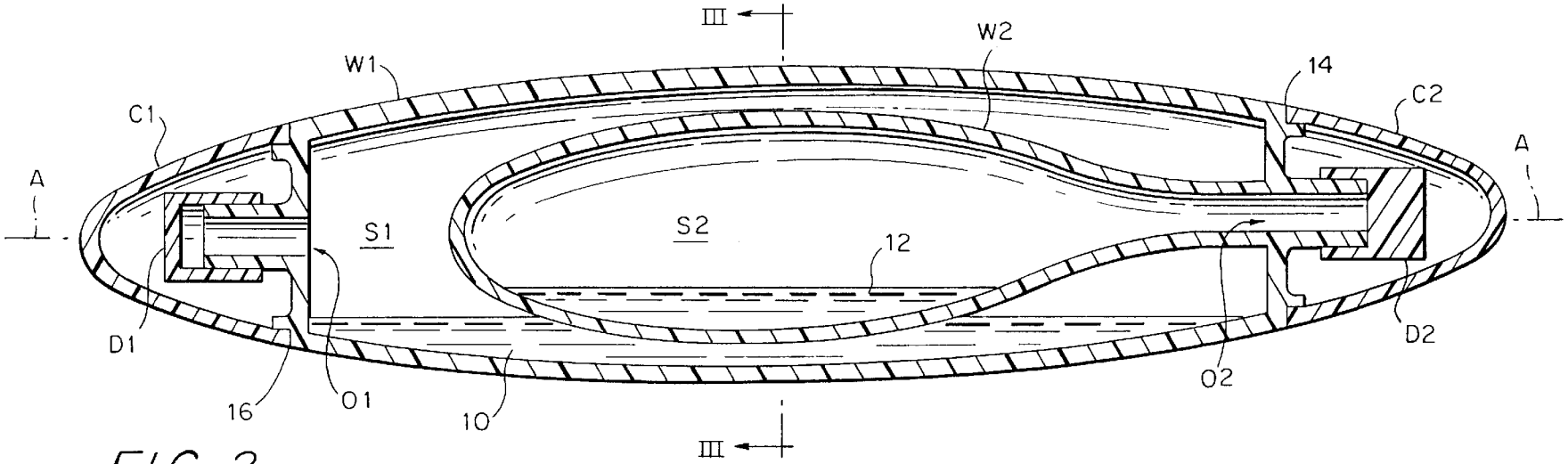
FIG. 2 a cross-sectional view taken on a plane in which the axis of the bottle and caps lies.
Figure 3:
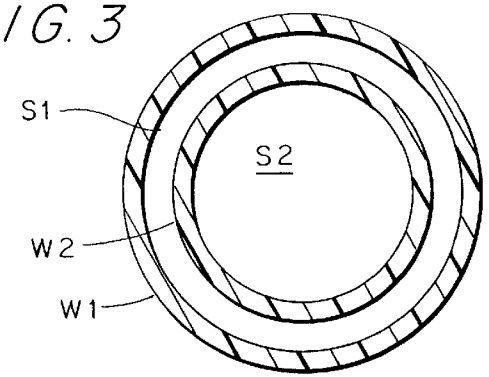
FIG. 3 is a cross-sectional along line III—III view on a plane, perpendicular to the axis of the bottle and to the plane of FIG. 2, located at the midpoint and the greatest circumference of the bottle.

Here and in the following claims:

"bottle" includes all containers for holding a liquid wherein the walls of the container are either fully rigid, e.g. formed of glass or rigid plastic, or sufficiently rigid that the container assumes a fixed shape and returns to that fixed shaped after elastic deformation, e.g. formed of flexible or resilient plastic;

"liquid" includes all flowing substances, such as solutions, emulsions, colloids, gels, or aerosols;

A best mode contemplated for the present invention is shown in FIG. 1, and cross-sections of the same embodiment are shown in FIGS. 2 and 3. The same reference numerals are used throughout the drawing figures for the same parts. FIG. 2 shows a cross section across the axis A of FIG. 1; FIG. 3 is a cross section on III—III as shown in FIG. 2, and FIG. 2 is a longitudinal cross-section.

The bottle of the invention incorporates two distinct containers, so that the one bottle acts like two: it has two interior spaces S1, S2 for two different liquids; it has two openings O1, O2 for dispensing the two liquids; and it desirably has two closures/dispensers D1, D2 for independent dispensing of the two liquids from either end of the bottle.

Preferably, the bottle is highly symmetrical in two ways: first, radially around a longitudinal axis of symmetry A; and second, bilaterally across a plane perpendicular to the axis. It is also very smooth, presenting a curve of mathematical simplicity and elegance, although its exterior may be textured or ornamented if desired.

The bottle is primarily intended for perfumes, colognes, and similar liquids for which packaging is extremely important. The dual dispensing of the invention does more than doubling the convenience of dispensing by containing two liquids in one bottle; it also presents a prospective purchaser with an intriguing structure, not seen before, which attracts attention and can lead to a sale.

Two different perfumes 10 and 12 respectively, of complementary aroma may be held in the two spaces S1, S2. A user may apply them alone or in combination. A relatively expensive material can be contained within the protected inner chamber.

The unique shape of the outer surface is not only well-adapted to the double-ended dispensing structure; it also creates psychological effects, important in perfume bottles. The functional structure and the appearance interact to increase sales, and therefore the two together have utility beyond the utility of manufacture. Moreover, the preferably transparent walls W1, W2 further enhance the appearance. Different combinations of colored and colorless walls W1, W2 may be used.

The container outer wall W1 surrounds the outer inside space S1. The outer wall W1 includes a first opening from which the first liquid (not shown) is dispensed from the outer space. The first opening has a first closure D1, which is shown as a spray fitting or spray head in FIG. 1; although any conventional sort of closure can be used; pump, applicator, simple closure cap, etc.

The container inner wall W2 forms an inner container which surrounds an inner space S2 for holding the second liquid (not shown). The inner container has an inner-space second opening O2 and a second closure D2 for dispensing the second liquid, which may be of a the same or of a different type from the first closure D1.

Where dispensers D1 and D2 are used instead of simple openings, two end caps C1 and C2 fit over the dispensers. These caps are shown exploded away from the rest of the bottle in FIG. 1. The caps have cap surfaces that smoothly connect with the outer surface of the bottle. The overall outer surface of the bottle is preferably smooth at the joints 14 and 16 between the caps and the outer surface of the wall W1, with no discontinuity. Preferably also, the overall surface is a figure of revolution about an axis A, and is moreover bilaterally symmetrical about a plane perpendicular to the axis, where the symmetry plane is located at the midpoint of the bottle (which is also the greatest diameter in the embodiment shown), thus taking the overall general shape of a torpedo or cigar with tapered opposite ends as best shown in FIG. 2.

In an alternate embodiment, the caps C1, C2 and the closures D1, D2 can be combined. For example, the caps C1 and C2 may be screw-on caps which stop the openings O1 and O2, respectively.

The outer wall and the inner wall are joined adjacent the second opening to form a continuous double envelope, so that topologically, the bottle walls W1 and W2 form a simple container with a pushing-in bottom. The weight of the inner container (wall W2 and the second liquid) is held by the strength of the neck of the inner container.

In the embodiment shown, the main part of the bottle (exclusive of the end caps) has flat ends through which the two openings O1, O2 protrude.

If formed of glass, the present container can be made by conventional glass blowing techniques. If formed of plastic, it can be made in various ways including blow molding, vacuum forming, injection molding, and combinations of these techniques.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is for the purpose of description and not of limitation.

What is claimed is:

1. A double-ended bottle comprising:

a container outer wall surrounding an outer space, the outer wall including a first neck structure defining a first opening to the outer space;

a first closure for closing the first opening to contain a first liquid within the outer space;

a container inner wall surrounding an inner space, the inner wall including a second neck structure defining a second opening to the inner space;

each neck structure is spaced radially from and in contact with said outer wall:

a second closure for closing the second opening to contain a second liquid within the inner space;

and wherein:

(a) the outer wall and the inner wall are joined adjacent the second opening to form a continuous and unitary double envelope;

(b) the inner wall is disposed within the outer wall;

(c) the outer space is disposed between the outer wall and the inner wall, and the inner space is disposed substantially within the inner wall;

(d) the first opening is located at a first end of the bottle and the second opening is located at a second end of the bottle; and (e) the outer space contains a first fragrance-containing toiletry liquid, and the inner space contains a second fragrance-containing toiletry liquid different from said first fragrance-containing toiletry liquid.

2. The bottle according to claim 1, wherein the first opening is located in a first flat end portion of the outer wall, and the second opening is located in a second flat end portion of the inner wall.

3. The bottle according to claim 1, including a first end cap mountable on the bottle for covering the first closure and a second end cap mountable on the bottle for covering the second closure.

4. The bottle according to claim 3 wherein the outer wall together with said first end cap and said second end cap define a torpedo-shaped bottle with opposite ends progressively tapered to increasingly smaller diameters.

5. The bottle according to claim 3, wherein the first end cap and the second end cap include respective outer cap surfaces and wherein, when the first end cap and the second end cap are both mounted on the bottle, the cap surfaces smoothly connect with an outer surface of the outer wall, such that an overall surface is smooth and is a figure of revolution about an axis.

6. The bottle according to claim 5, wherein the overall surface curved along its length and is symmetrical about a plane perpendicular to the axis.

7. The bottle according to claim 1, wherein the first closure and the second closure include respective outer closure surfaces and wherein, when the first closure and the second closure are both mounted on the bottle, the closure surfaces smoothly connect with an outer surface of the outer wall, such that an overall surface is smooth and is a figure of revolution about an axis.

8. The bottle according to claim 7, wherein the overall surface curved along its length and is symmetrical about a plane perpendicular to the axis.

9. A double-ended and double-compartment unitary bottle especially adapted for containing a fragrance-containing toiletry liquid comprising:

an elongated container outer wall closed at a first end thereof and having a first opening at a second end thereof;

an elongated container inner wall within, coaxial and integral with said outer wall, said outer wall and said inner wall defining a liquid-tight annular space therebetween for containing a first fragrance-containing toiletry liquid;

said elongated container inner wall being closed at an end thereof adjacent to said second end and having a second opening extending through and adjacent said first end;

said elongated container inner wall defining a liquid-tight inner compartment for containing a second fragrance-containing toiletry liquid, said inner compartment being located within and surrounded by said annular space with said container inner wall therebetween; and said first end and said second end both being flat and being located at opposite ends of said bottle, said first end including a first neck structure defining said first opening and said second end including a second neck structure defining said second opening, each neck structure being spaced radially from and in contact with said outer wall.

* * * * *

UNITED STATES PATENT AND TRADEMARK OFFICE

CERTIFICATE OF CORRECTION

PATENT NO. : 5,803,268

DATED : Sep. 8, 1998

INVENTOR(S) : Brad Levy et al.

It is certified that error appears in the above-identified patent and that said Letters Patent is hereby corrected as shown below:

Cover page, column 2, in the Abstract, line 3, delete "eg." and insert therefor --e.g.--.

Column 1, line 5, delete "fragrance containing" and insert therefor --fragrance-containing--.

Column 2, line 14, delete "embodiments" and insert therefor --embodiment(s)--;

line 20, after "Cross-sectional" insert --view-- and after "III-III" delete "view";

line 65, after "12", insert --,--.

UNITED STATES PATENT AND TRADEMARK OFFICE

CERTIFICATE OF CORRECTION

PATENT NO. : 5,803,268

DATED : Sep. 8, 1998

INVENTOR(S) : Brad Levy et al.

It is certified that error appears in the above-identified patent and that said Letters Patent is hereby corrected as shown below:

Column 4, line 56, after "surface" insert --is-- and delete "is" after "and";

line 66, after "surface" insert --is-- and delete "is" after "and".

Signed and Sealed this

Fifth Day of January, 1999

*Attest:*

*Attesting Officer*

*Acting Commissioner of Patents and Trademarks*